US005943974A

United States Patent [19]

Hoag

[11] Patent Number: 5,943,974

[45] Date of Patent: Aug. 31, 1999

[54] GATHERING GAUGE

[76] Inventor: Barbara Jones Hoag, 1347 Valley Home Rd., Dandridge, Jefferson County, Tenn. 37725

[21] Appl. No.: 09/136,253

[22] Filed: Aug. 18, 1998

Related U.S. Application Data

[63] Continuation-in-part of application No. 08/922,209, Sep. 2, 1997.

[51] Int. Cl.[6] ..... D05B 35/08; B43L 13/00

[52] U.S. Cl. ..... 112/475.01; 112/146; 223/28; 33/492; 33/566; 33/2 R

[58] Field of Search ..... 112/102, 103, 112/118, 119, 146, 150, 153, 470.17, 475.22, 475.21, 439, 475.01; 223/28, 35; 33/485, 492, 44, 42, 566, 562, 2 R

[56] References Cited

U.S. PATENT DOCUMENTS

| | | | |
|---|---|---|---|
| 2,250,718 | 7/1941 | McCloud | 223/28 |
| 3,029,004 | 4/1962 | Schiavone | 223/28 |
| 3,090,533 | 5/1963 | Claeys | 223/28 |
| 3,369,303 | 2/1968 | Henry | 223/28 |
| 3,724,729 | 4/1973 | Sitts | 223/35 |
| 4,986,005 | 1/1991 | Grippi et al. | 33/563 |
| 5,319,859 | 6/1994 | Smith | 22/563 |
| 5,749,149 | 5/1998 | Claytor | 33/12 |

*Primary Examiner*—John J. Calvert
*Assistant Examiner*—Tejash D Patel
*Attorney, Agent, or Firm*—Pitts & Brittian, P.C.

[57] ABSTRACT

A gathering gauge for assisting in the fabrication of a gather in a sewn article of manufacture. The gathering gauge is used to evenly distribute a given length of a fabric over a selected gather length, thereby eliminating guess work normally associated with such task. The gathering gauge is an elongated member defining a first slit for receiving and holding one end of a thread used to gather the fabric. A plurality of second slits is provided for receiving and holding a further portion of the thread. The second slits are disposed along the length of the gathering gauge at preselected distances from the first slit. A measuring guide is provided for determining the distance between the first slit and each individual second slit. Thus, depending upon the length of the fabric to be gathered, and either the length of the gather or the amount of gather desired, a particular second slit is selected.

4 Claims, 2 Drawing Sheets

GATHERING GAUGE

This application is a Continuation-in Part of Ser. No. 08/922,209, filed on Sep. 2, 1997.

TECHNICAL FIELD

This invention relates to the field of sewing. More specifically, this invention relates to a device for assisting in the fabrication of a gather in a sewn article of manufacture.

BACKGROUND ART

It is well known to those skilled in the art of sewing that gathered portions of material are common, and that such can be difficult to manufacture. For example, gathers are commonly used in the manufacture of clothing articles such as women's skirts, draperies, and decorative items such as quilted products. However, it is well known that in the fabrication of a gather, making each gather, or pleat, of consistent size can be very difficult. This is especially the case where a given width of fabric must be used to create a gather of a given size. For example, a specific drapery may require a bottom width of three feet (3') and a top width of two feet (2'). In this instance, a three foot width of material must be evenly gathered to a two foot width.

In another example, a quilted square may define a four inch (4") piece of fabric that must be gathered to define a three inch (3") square. In either of these examples, or in any other situations in which a gather must be formed, the finished gather is typically formed using trial and error methods of evenly distributing the gathers along the width of the fabric. However, prior to the present invention, there has been no mechanism provided for accurately and conveniently forming the gathers.

Therefore, it is an object of this invention to provide a device for assisting in the fabrication of a gather in a sewn material.

Another object of the present invention is to provide such a device whereby a first given length of fabric may be quickly and evenly gathered into a second given length.

DISCLOSURE OF THE INVENTION

Other objects and advantages will be accomplished by the present invention which serves to assist in the fabrication of a gather in a sewn article of manufacture. The gathering gauge is used to evenly distribute a given length of a fabric over a selected gather length, thereby eliminating guess work normally associated with such task. The gathering gauge is an elongated member defining a first slit for receiving and holding one end of a thread used to gather the fabric. A plurality of second slits is provided for receiving and holding a further portion of the thread. The second slits are disposed along the length of the gathering gauge at pre-selected distances from the first slit. A measuring guide is provided for determining the distance between the first slit and each individual second slit. Thus, depending upon the length of the fabric to be gathered, and either the length of the gather or the amount of gather desired, a particular second slit is selected.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A gathering gauge incorporating various features of the present invention and a method for using the same are illustrated generally at 10 in the figures. The gathering gauge 10 is provided for assisting in the fabrication of a gather in a sewn article of manufacture, such as articles of clothing, draperies, and decorative items such as quilted products. The gathering gauge 10 is used to evenly distribute a given length of a fabric over a selected gather length, thereby eliminating guess work normally associated with such task.

Figure 1:
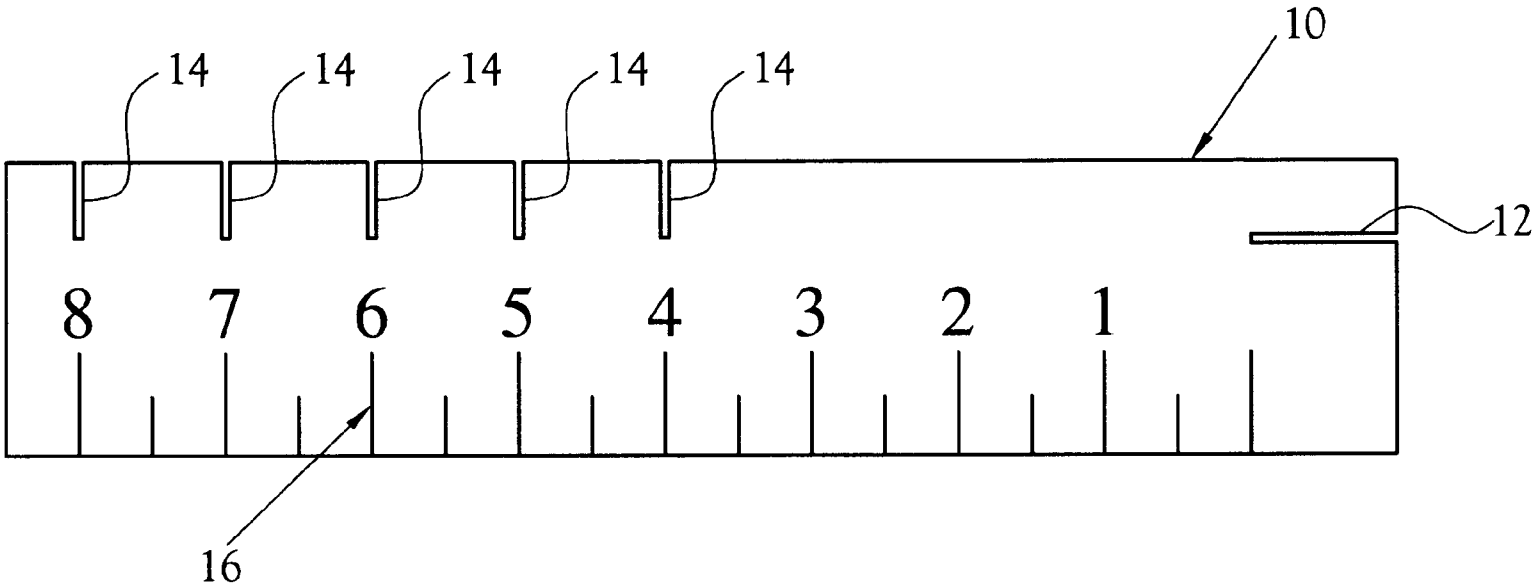
FIG. 1 is a top plan view of the gathering gauge of the present invention.

As illustrated in FIG. 1, the gathering gauge 10 is generally an elongated member defining a first slit 12 for receiving and holding one end 22 of the thread 20 used to gather the fabric 18. The first slit 12 is preferably disposed in an end of the gathering gauge 10 such that pulling on the thread 20 serves to secure the first end 22 thereof within the first slit 12. A plurality of second slits 14 is provided for receiving and holding a further portion of the thread 20. The second slits 12 are disposed along the length of the gathering gauge 10 at pre-selected distances from the first slit 12. A measuring guide 16 is provided for determining the distance between the first slit 12 and each individual second slit 14. Thus, depending upon the length of the fabric 18 to be gathered, and the amount of gather desired, a particular second slit 16 is selected.

Figure 2:
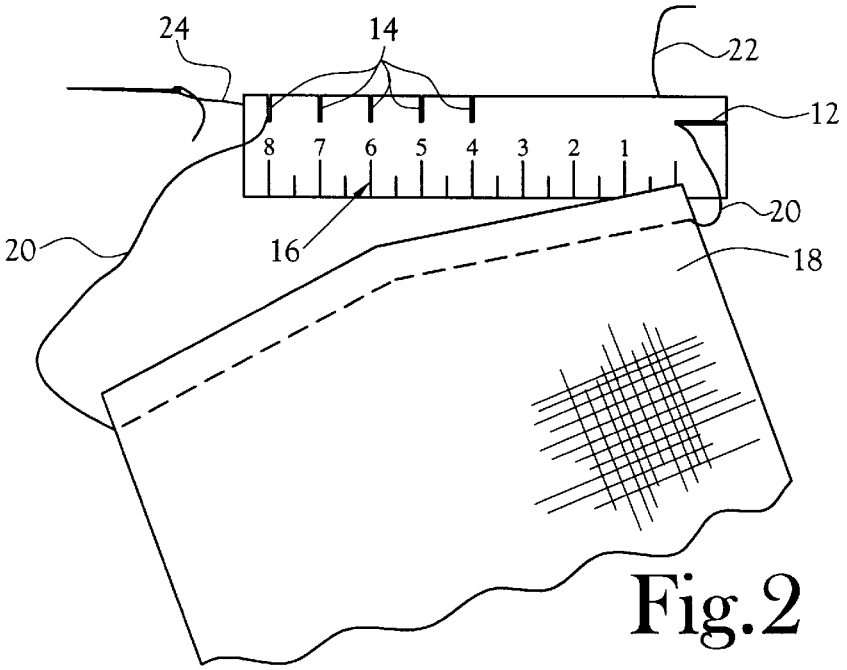
FIG. 2 illustrates a thread, after being stitched into a piece of fabric, being mounted on the gathering gauge of FIG. 1.

The measuring guide 16 includes indicia related to the distance between the first slit 12 and each of the second slits 14 and may be configured in any of several ways. First, the indicia may simply define the exact distance between the first slit 12 and each of the second slits 14. This configuration will allow one to define a gather of a specified length. For example, given a piece of fabric 18 and desiring a gather of eight inches (8"), as illustrated in FIG. 2, the second slit 14 corresponding to 8" is chosen and the selected gather formed. In a second embodiment, the scale of the indicia is selected based upon the amount of gather desired. For example, in some situations a 2:1 gather is desired, where 8" of material is used to define a 4" gather. In this instance the scale of the indicia is set at 2:1. Thus, for the exemplary 8" fabric 18, the second slit 14 corresponding to 8" is selected, thus forming a 4" gather. Other scales such as 2:3 may be used as well to form gathers of proportional ratios.

Figure 3:
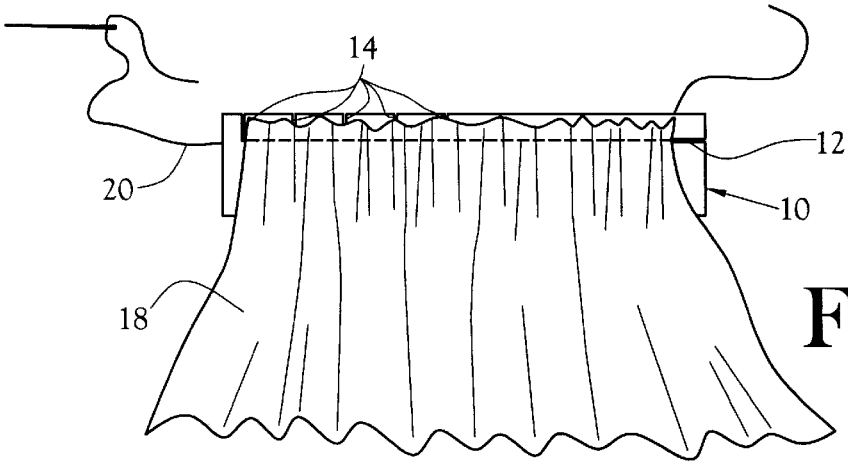
FIG. 3 illustrates the fabric of FIG. 2 having been gathered using the gathering gauge of FIG. 1.
Figure 4:
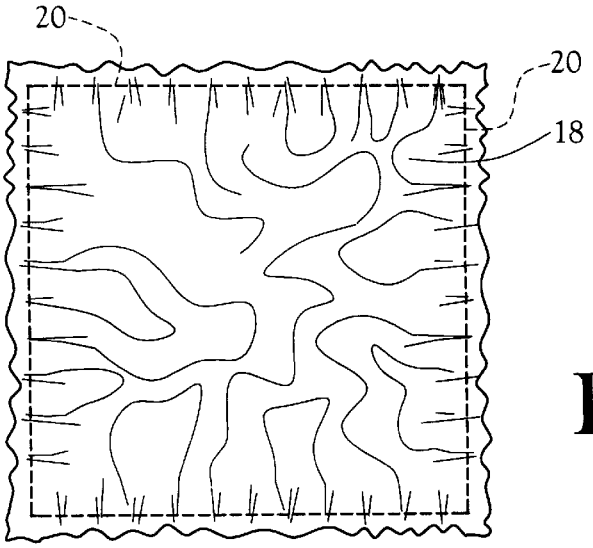
FIG. 4 illustrates a fabric square after all four sides thereof have been gathered using the gathering gauge of the present invention.

The gathering gauge 10 is used as illustrated in FIGS. 2–4. First, the appropriate gathering gauge 10 is selected, depending upon the known characteristics of each of the fabric 18 and the gather. Second, a thread 20 used to gather the fabric 18 is loosely stitched along the edge of the fabric 18 to be gathered. One end 22 of the thread 20 is then inserted into the first slit 14 and held in place. In order to maintain the first end 22 of the thread 20 within the first slit 12, a knot may be tied in the thread 20. The second end 24 of the thread 20 is then inserted into the appropriate second slit 16 and then pulled to gather the fabric 18, as illustrated in FIG. 3. The fabric 18 is then adjusted to be evenly distribute across the gather. The gathered fabric 18 may then be removed from the gathering gauge 10. It may be desirable to sew along the gather in order to secure the gather, or it may be desirable to sew the gathered fabric 18 to another article. Illustrated in FIG. 4 is a fabric 18 which has been gathered and sewn along all four sides in order to form a square used in a quilt having puffed squares.

From the foregoing description, it will be recognized by those skilled in the art that a gathering gauge and method for using offering advantages over the prior art has been provided. Specifically, the gathering gauge and method for using provides a means for forming a uniform gather in an article of manufacture such as an article of clothing, draperies, and decorative items such as quilted products. The gathering gauge provides a means for fabricating a uniform gather given the length of the fabric to be gathered and either the finished length of the gather or the ratio of the ungathered and gathered lengths of the fabric.

While a preferred embodiment has been shown and described, it will be understood that it is not intended to limit the disclosure, but rather it is intended to cover all modifications and alternate methods falling within the spirit and the scope of the invention as defined in the appended claims.

I claim:

1. A gathering gauge for assisting in fabricating a gather in a fabric, a thread being stitched in the fabric along an edge thereof to be gathered, said gathering gauge comprising:

an elongated member defining at least a first end and a first edge, said first edge being parallel to an elongated axis;

a first slit defined by said elongated member at said first end for receiving a first end of a thread, said first slit being disposed substantially parallel to said elongated axis;

at least one second slit defined by said elongated member along said first edge for receiving a second end of the thread, said at least one second slit being disposed at a substantially orthogonal angle with respect to said elongated axis and with respect to said first slit such that pulling the thread toward said at least one second slit when the first end of the thread has been received in said first slit serves to further engage the thread in said first slit; and a measuring guide for assistance in selecting one of said at least one second slit, said measuring guide including indicia to indicate a distance from said first slit to each of said at least one second slit.

2. The gathering gauge of claim 1 wherein said measuring guide indicia corresponds to a distance between said first slit and said at least one second slit and is provided for selecting a length at which the gather is to be fabricated.

3. The gathering gauge of claim 1 wherein said measuring guide indicia corresponds to a distance between said first slit and said at least one second slit and is indicative of the length of the fabric prior to gathering.

4. A method for fabricating a gather in a piece of fabric using a gathering gauge having an elongated member defining a first slit for receiving a first end of a thread and at least one second slit for receiving a second end of the thread and a measuring guide for assistance in selecting one of said at least one second slit, said measuring guide including indicia to indicate a distance from said first slit to each of said at least one second slit, said method comprising the steps of:

A) stitching a thread through a length of the fabric to be gathered;

B) inserting a first end of the thread into said gathering gauge first slit;

C) inserting a second end of the thread into one of said at least one second slit of said gathering gauge;

D) pulling the second end of the thread through said second slit in order to form the gather in the fabric;

E) evenly distributing the fabric over the length of the gather; and

F) removing the gathered fabric from said gathering guide.

* * * * *